US010807365B2

(12) United States Patent
Sugiura et al.

(10) Patent No.: US 10,807,365 B2
(45) Date of Patent: Oct. 20, 2020

(54) LIQUID JETTING APPARATUS

(71) Applicant: Brother Kogyo Kabushiki Kaisha, Nagoya-shi, Aichi-ken (JP)

(72) Inventors: Keita Sugiura, Toyokawa (JP); Shohei Koide, Nagoya (JP); Jiro Yamamoto, Nagoya (JP); Hiroshi Katayama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/271,193

(22) Filed: Feb. 8, 2019

(65) Prior Publication Data

US 2019/0299609 A1 Oct. 3, 2019

(30) Foreign Application Priority Data

Mar. 30, 2018 (JP) ..... 2018-068286

(51) Int. Cl.
*B41J 2/14* (2006.01)

(52) U.S. Cl.
CPC ..... *B41J 2/1433* (2013.01); *B41J 2/14201* (2013.01)

(58) Field of Classification Search
CPC ..... B41J 2/14201; B41J 2/1433
See application file for complete search history.

(56) References Cited

U.S. PATENT DOCUMENTS

2003/0156166 A1* 8/2003 Sakaida ..... B41J 2/14209 347/68
2018/0201019 A1* 7/2018 Seto ..... B41J 2/14233

FOREIGN PATENT DOCUMENTS

JP 2011-245795 A 12/2011

* cited by examiner

*Primary Examiner* — Matthew Luu
*Assistant Examiner* — Kendrick X Liu
(74) *Attorney, Agent, or Firm* — Banner & Witcoff, Ltd.

(57) ABSTRACT

A liquid jetting apparatus includes a nozzle plate having a nozzle, and a channel unit having a first surface facing and joined with the nozzle plate. The channel unit has a first channel member having the first surface, and a second channel member having a second surface facing and joined with the first channel member. The second channel member is formed with a first pressure chamber, a second pressure chamber, a first opening and a second opening defined by the second surface, a first connecting channel connecting the first pressure chamber and the first opening, and a second connecting channel connecting the second pressure chamber and the second opening. The first channel member is formed with a third connecting channel connecting the first pressure chamber and the second pressure chamber.

14 Claims, 11 Drawing Sheets

LIQUID JETTING APPARATUS

CROSS REFERENCE TO RELATED APPLICATION

The present application claims priority from Japanese Patent Application No. 2018-068286 filed on Mar. 30, 2018, the disclosure of which is incorporated herein by reference in its entirety.

BACKGROUND

Field of the Invention

The present invention relates to a liquid jetting apparatus configured to jet liquid from nozzles.

DESCRIPTION OF The RELATED ART

As disclosed in, for example, Japanese Patent Application Laid-open No. 2011-245795, there is known a liquid jetting apparatus including two piezo elements arranged to correspond to one nozzle and configured to circulate ink in the vicinity of the nozzles.

SUMMARY

However, in the liquid jetting apparatus having the above configuration, even if the ink is circulated in the vicinity of the nozzle, when the ink has a slow flow speed, the thickened and/or solidified ink is still liable to stay in the vicinity of the nozzle but not to flow downstream.

An object of the present teaching is to prevent nozzles from jetting defects due to drying of liquid, in a liquid jetting apparatus including pressure chambers and link channels where the nozzles are disposed.

According to a first aspect of the present teaching, there is provided a liquid jetting apparatus including: a nozzle plate having a nozzle; and a channel unit having a first surface facing the nozzle plate, the first surface being joined with the nozzle plate, wherein the channel unit has: a first channel member having the first surface; and a second channel member having a second surface facing the first channel member, the second surface being joined with the first channel member, wherein the second channel member is formed with: a first pressure chamber; a second pressure chamber; a first opening defined by the second surface; a second opening defined by the second surface; a first connecting channel connecting the first pressure chamber and the first opening; and a second connecting channel connecting the second pressure chamber and the second opening, wherein the first channel member is formed with a third connecting channel connecting the first pressure chamber and the second pressure chamber, the third connecting channel communicating with the first connecting channel through the first opening and communicating with the second connecting channel through the second opening, and wherein in the third connecting channel, a communication portion in communication with the nozzle has a cross-sectional area perpendicular to a first direction smaller than that of another portion, the first direction being a direction along the first surface.

According to a second aspect of the present teaching, there is provided a liquid jetting apparatus including: a nozzle plate having a nozzle; and a channel unit having a first surface facing the nozzle plate, the first surface being joined with the nozzle plate, wherein the channel unit is formed with: a first pressure chamber; a second pressure chamber; and a link channel linking the first pressure chamber and the second pressure chamber, wherein the first surface is formed with an opening defining a contour of an end portion, of the link channel, on a side of the nozzle plate, wherein the opening is covered by the nozzle plate, wherein the first pressure chamber and the second pressure chamber are arranged in a first direction parallel to the first surface, and wherein in the link channel, a communication portion in communication with the nozzle has a cross-sectional area perpendicular to the first direction smaller than that of each of the first pressure chamber and the second pressure chamber.

According to the above configurations, in the link channel, because it is possible to increase speed of the liquid flowing through the communication portion, it is possible to prevent the dried liquid from staying in the vicinity of the nozzle.

According to the present teaching, it is possible to prevent the nozzle from jetting defects due to liquid drying, in a liquid jetting apparatus including pressure chambers and a link channel where a nozzle is arranged.

DESCRIPTION OF THE EMBODIMENTS

Hereinbelow, referring to the accompanying drawings, respective embodiments of the present teaching will be explained.

[First Embodiment] <Overall Configuration of a Printer>

Figure 1:
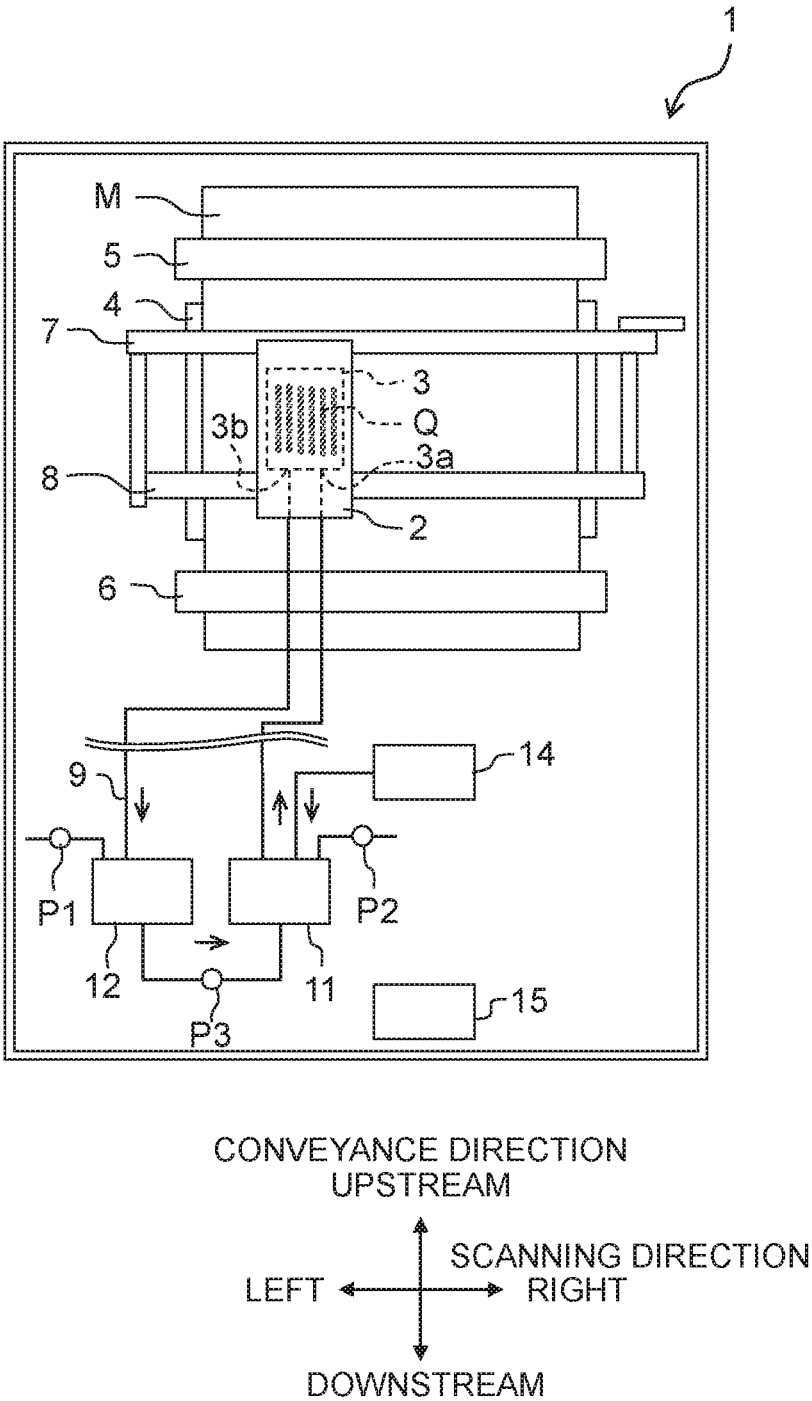
FIG. 1 is a schematic configuration diagram of a printer according to a first embodiment of the present teaching.

A printer 1 is an example of liquid jetting systems. As depicted in FIG. 1, the printer 1 includes a carriage 2, an ink jet head 3, a platen 4, conveyance rollers 5 and 6, a pressurizing tank 11, a negative pressure tank 12, air pumps P1 and P2, an ink pump P3, a tank 14, and a controller 15.

The carriage 2 is supported by two guide rails 7 and 8 extending in a scanning direction to move reciprocatingly together with the ink jet head 3 along the guide rails 7 and 8 in the predetermined scanning direction. Hereinbelow, the right side of the page of FIG. 1 is defined as the right side of the scanning direction and the left side of the page is defined as the left side of the scanning direction.

The ink jet head 3 is an example of the liquid jetting apparatus, and is mounted on the carriage 2. The ink jet head 3 is, as will be described later on, provided with 72 nozzles 201 to jet an ink as an example of liquid (see FIG. 2), four supply ports 3*a*, and three discharge ports 3*b*. Note that in FIG. 1, for convenience in illustration, only one supply port 3*a* and one supply port 3*b* are depicted.

The supply ports 3*a* are connected with ends of a pipe 9 at one side, while the discharge ports 3*b* are connected with ends of the pipe 9 at the other side. The pipe 9 is connected midway with the pressurizing tank 11, the negative pressure tank 12, and the ink pump P3. The pressurizing tank 11 retains the ink. The pressurizing tank 11 is connected with the air pump P2 pressurizing the ink with air, and the supply tank 14 supplying the ink to the pressurizing tank 11. The pressurizing tank 11 is connected to such a part of the pipe 9 as close to the supply ports 3*a*. With the air pump P2 raising the pressure of the air in the pressurizing tank 11, the ink in the pressurizing tank 11 is pressurized to supply the pipe 9 with the ink retained in the pressurizing tank 11.

The negative pressure tank 12 also retains the ink. The negative pressure tank 12 is connected with the air pump P1 depressurizing the ink with air. The negative pressure tank 12 is connected to such a part of the pipe 9 as close to the discharge ports 3*b*. With the air pump P1 lowering the pressure of the air in the negative pressure tank 12, part of the ink flowing through the pipe 9 is sucked up into the negative pressure tank 12.

The ink pump P3 is arranged at the pipe 9 between the tanks 11 and 12. The ink pump P3 supplies the ink to the pressurizing tank 11 from the negative pressure tank 12. In the printer 1, along with the driving of the pumps P1 to P3, the ink circulates inside the respective parts of the pipe 9 and ink jet head 3.

The platen 4 is arranged to face the nozzles 201 of the ink jet head 3, and to extend in the scanning direction and in a conveyance direction orthogonal to the scanning direction. A recording sheet M is placed on the platen 4. The conveyance rollers 5 and 6 convey the recording sheet M along the conveyance direction. The conveyance roller 5 is arranged on the upstream side from the carriage 2 in the conveyance direction while the conveyance roller 6 is arranged on the downstream side from the carriage 2 in the conveyance direction. The controller 15 individually controls the carriage 2, the pumps P1 to P3, the conveyance rollers 5 and 6, and piezoelectric elements 22*c* (see FIG. 4).

In the printer 1, due to the control by the controller 15, each time the recording sheet M is conveyed by the conveyance rollers 5 and 6 in the conveyance direction through a predetermined distance, the carriage 2 is moved in the scanning direction and the ink is jetted from the 72 nozzles 201 of the ink jet head 3. By virtue of this, printing is carried out on the recording sheet M.

Ink Jet Head

As depicted in FIGS. 2 to 5, the ink jet head 3 has a nozzle plate 20, a channel unit 21, and the piezoelectric elements 22*c*.

The nozzle plate 20 has the nozzles 201. The nozzle plate 20 in this embodiment is formed therein with the 72 nozzles 201 penetrating therethrough in the plate-thickness direction. In the nozzle plate 20, six nozzle rows are arranged in predetermined positions at intervals in the scanning direction. Each of the nozzle rows is formed from 12 nozzles 201. Further, the 12 nozzles 201 of each nozzle row are aligned in the conveyance direction at predetermined intervals.

Channel Unit

A channel unit 21 has the surface S1 facing the nozzle plate 20. The surface S1 is attached to the nozzle plate 20. The channel unit 21 is formed with the pressure chambers 211*a*, pressure chambers 211*b*, throttle channels 212*a*, throttle channels 212*b*, descender channels 213*a*, descender channels 213*b*, and channels 214, each set of which has 72 members. Further, the channel unit has 4 manifolds 215*a*, 3 manifolds 215*b*, 4 damper chambers 216*a*, and 3 damper chambers 216*a*.

The pressure chambers 211*a* and the pressure chambers 211*b* are linked through the descender channels 213*a*, the channels 214, and the descender channels 213*b*. The channels 214 connect the descender channels 213*a* and the descender channels 213*b*. In this embodiment, link channels 260 refer to the channels formed from the descender channels 213*a*, the channels 214, and the descender channels 213*b*. That is, the channel unit 21 is formed with the link channels 260.

Figure 4:
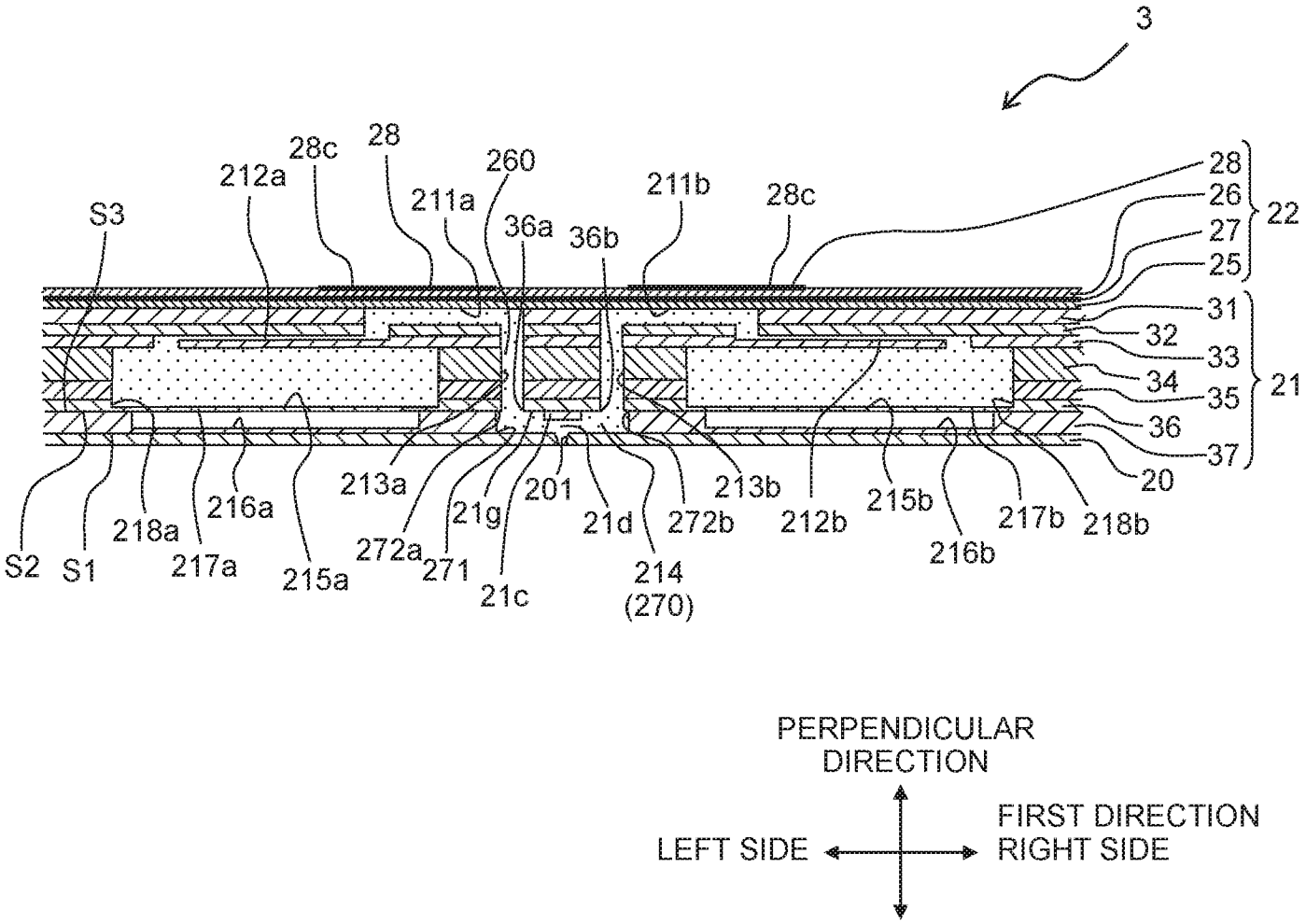
FIG. 4 is a cross-sectional view of FIG. 3 along the line IV-IV.
Figure 5:
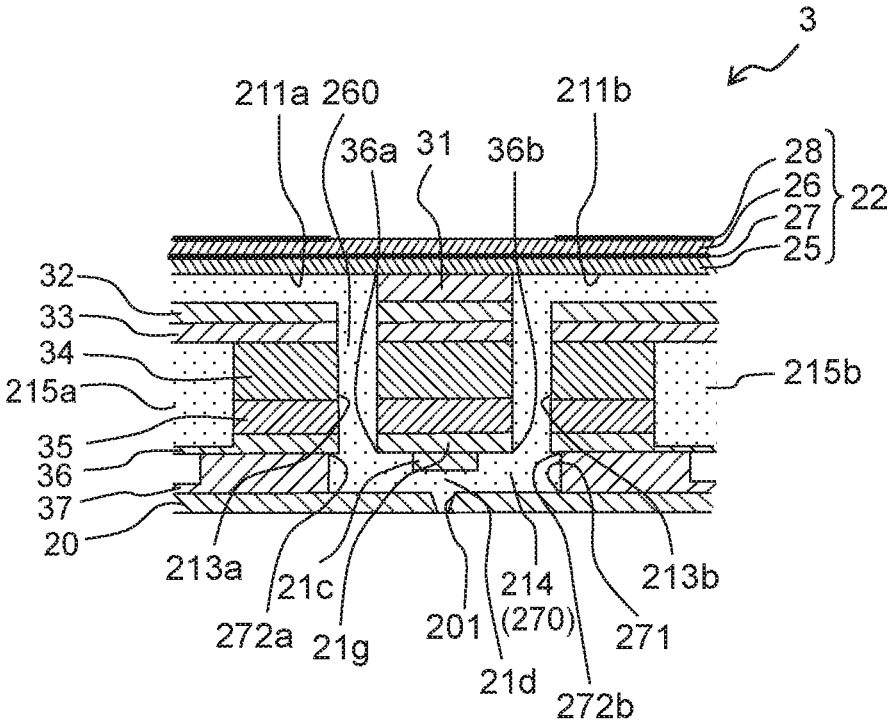
FIG. 5 is an enlarged view of FIG. 4.

As depicted in FIGS. 4 and 5, the channel unit 21 is constructed from a stacked body where seven plates 31 to 37 are stacked in layers along a direction perpendicular to the surface S1. The plates 31 to 37 are stacked in the numbering order in the orientation approaching the platen 4 in the direction perpendicular to the surface S1. The seven plates 31 to 37 in the stacked body are attached to each other with a thermosetting adhesive.

The plate 37 has the surface S1 facing the nozzle plate 20, and the surface S3 facing the plate 36. The surface S1 is the lower surface of the plate 37. The surface S3 is the upper surface of the plate 37. The plate 37 is formed therein with spaces 270 to form the channels 214. The nozzle plate 20 covers openings 271 of the spaces 270 at the side of the nozzle plate 20. That is, the openings 271 define the contours of the ends of the channels 214 at the side of the nozzle plate 20.

The surface S3 of the plate 37 is formed with, as will be described in detail later on, openings 272*a* in communication with the descender channels 213*a* through openings 36*a*, and openings 272*b* in communication with the descender channels 213*b* through openings 36*b*.

Here, the ink jet head 3 has the same number 72 of link channels 260 as that of nozzles 201, That is, the surface S1 of the plate 37 defines the same number 72 of openings 271 as that of nozzles 201.

The plate 36 has the surface S2 facing the plate 37. The surface S2 is the lower surface of the plate 36 and is joined with the plate 37. The plate 36 is formed with the openings 36*a* and the openings 36*b*, each set of which has 72 members. The openings 36*a* serve as the boundaries between the descender channels 213*a*, and the channels 214 extending in a direction parallel to the surface S1. The openings 36*b* serve as the boundaries between the descender channels 213*b* and the channels 214.

The surface S2 defines the same number 72 of openings 36*a* as that of nozzles 201 and the same number 72 of openings 36*b* as that of nozzles 201. The openings 36*a* are at the surface S2 of the descender channels 213*a* while the openings 36*b* are at the surface S2 of the descender channels 213*b*. Further, the plate 36 has a plate portion 21*g*. The plate portion 21*g* is arranged between the openings 36*a* and the openings 36*b* in a first direction parallel to the surface S1.

Figure 2:
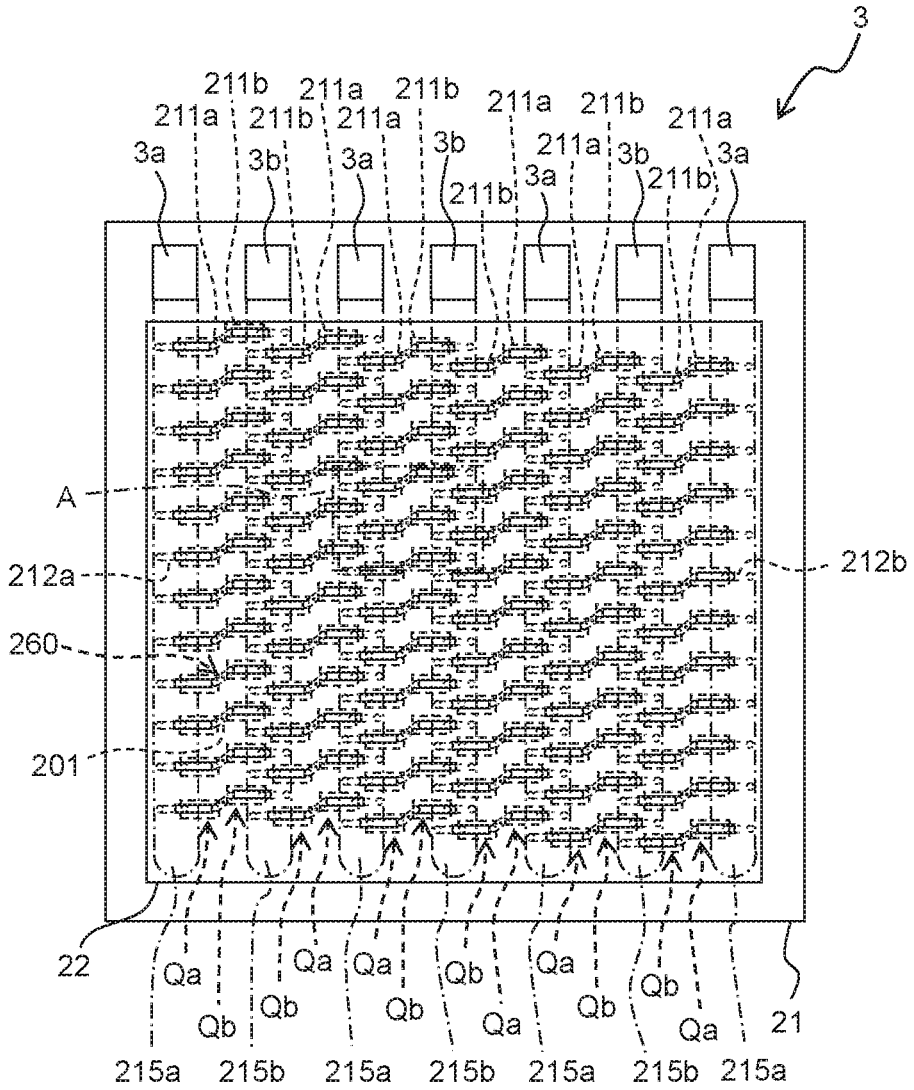
FIG. 2 is a plan view of an ink jet head in FIG. 1.
Figure 2:
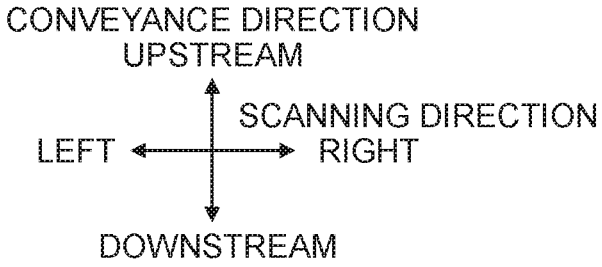
Figure 3:
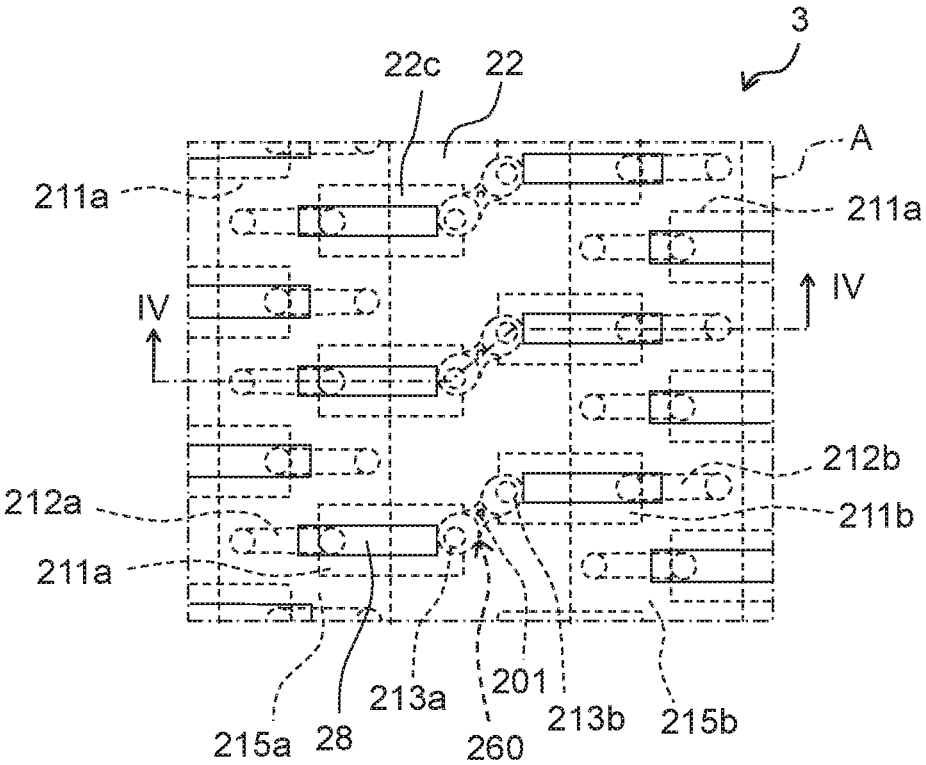
FIG. 3 is an enlarged view of the part enclosed with a chain line in FIG. 2.
Figure 3:
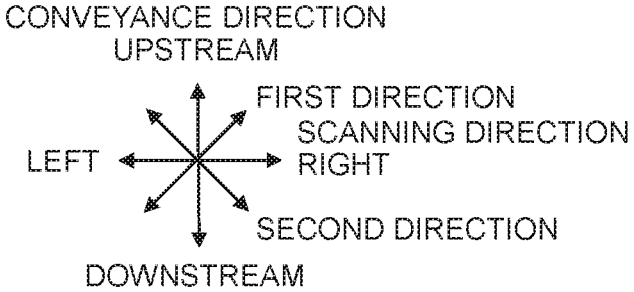

As depicted in FIGS. 2 to 4, the plate 31 is formed with the pressure chambers 211*a* and the pressure chambers 211*b*, each set of which has 72 members. The pressure chambers 211*a* and 211*b* are shaped with the scanning direction and the first direction respectively as their longitudinal directions. As viewed from a direction perpendicular to the surface S1, the pressure chambers 211*a* and 211*b* are shaped in rectangles. The pressure chambers 211*a* and 211*b* extend along a plane parallel to the scanning direction and the conveyance direction, respectively.

The 72 pressure chambers 211*a* form 6 pressure chamber rows Qa. Each of the pressure chamber rows Qa is formed from 12 pressure chambers 211*a*. Further, the 72 pressure chambers 211*b* form 6 pressure chamber rows Qb. Each of the pressure chamber rows Qb is formed from 12 pressure chambers 211*b*. The 12 pressure chambers 211*a* belonging to each pressure chamber row Qa and the 12 pressure chambers 211*b* belonging to each pressure chamber row Qb are arranged in the conveyance direction at a predetermined distance from each other.

The 6 pressure chamber rows Qa and the 6 pressure chamber rows Qb are arranged in the scanning direction. In particular, the 6 pressure chamber rows Qa and the 6 pressure chamber rows Qb are arranged, from left to right in the scanning direction, in the order of Qa, Qb, Qb, Qa, Qa, Qb, Qb, Qa, Qa, Qb, Qb, and Qa.

That is, except the two pressure chamber rows Qa at the left and right ends in the scanning direction, the pressure chamber rows Qa and the pressure chamber rows Qb are arranged in pairs successively in the scanning direction. In the adjacent pressure chamber row Qa and pressure chamber row Qb in the scanning direction, the pressure chambers 211*a* and 211*b* are shifted from each other at a pitch in the conveyance direction.

The plates 32 to 36 define the four manifolds 215*a* and the three manifolds 215*b*. Each of the manifolds 215*a* extends in the conveyance direction, and one end thereof in the conveyance direction is connected to the supply port 3*a*. Further, each of the manifolds 215*b* also extends in the conveyance direction, and one end thereof in the conveyance direction is connected to the supply port 3*b*.

The four manifolds 215*a* and the three manifolds 215*b* are arranged in the scanning direction. In particular, the four manifolds 215*a* and the three manifolds 215*b* are arranged, from left to right in the scanning direction, in the order of 215*a*, 215*b*, 215*a*, 215*b*, 215*a*, 215*b*, and 215*a*.

The pressure chambers 211*a* are connected with the manifolds 215*a* through the throttle channels 212*a*. Further, the pressure chambers 211*b* are connected with the manifolds 215*b* through the throttle channels 212*b*. The pressure chamber 211*a* and the pressure chamber 211*b* are arranged in the first direction parallel to the surface S1. For example, each of the pressure chambers 211*a* and 211*b* has a certain cross-sectional area perpendicular to the first direction. Further, the cross-sectional areas of the pressure chambers 211*a* and 211*b* are identical.

As depicted in FIG. 4, the throttle channels 212*a* are formed to cross over a boundary between the plates 32 and 33. Further, the throttle channels 212*b* are also formed to cross over the boundary between the plates 32 and 33. The throttle channels 12*a* are provided for the pressure chambers 211*a*. Further, the throttle channels 212*b* are provided for the pressure chambers 211*b*.

The throttle channels 212*a* provided for the pressure chambers 211*a* forming the first pressure chamber row Qa from the left of the page of FIG. 2 respectively connect the left ends of the pressure chambers 211*a* forming the pressure chamber row Qa and the manifold 215*a* adjacent to the left side of the pressure chamber row Qa. Much the same is true as the first pressure chamber row Qa on the third pressure chamber row Qb, the fifth pressure chamber row Qa, the seventh pressure chamber row Qb, the ninth pressure chamber row Qa, and the eleventh pressure chamber row Qb from the left of the page of FIG. 2. The throttle channels 212*b* provided for the pressure chambers 211*b* forming the second pressure chamber row Qb from the left of the page of FIG. 2 respectively connect the right ends of the pressure chambers 211*b* forming the pressure chamber row Qb and the manifold 215*b* adjacent to the right side of the pressure chamber row Qb. Much the same is true as the second pressure chamber row Qb on the fourth pressure chamber row Qa, the sixth pressure chamber row Qb, the eighth pressure chamber row Qa, the tenth pressure chamber row Qb, and the twelfth pressure chamber row Qa, from the left of the page of FIG. 2.

The descender channels 213*a* and 213*h* extend in a direction perpendicular to the surface S1. Each of the descender channels 213*a* is formed of through holes formed in the plates 32 to 37 to overlap with each other in the direction perpendicular to the surface S1. Each of the descender channels 213*b* is also formed of through holes formed in the plates 32 to 37 to overlap with each other in the direction perpendicular to the surface S1. The descender channels 213*a* are provided for the pressure chambers 211*a*. Further, the descender channels 213*b* are provided for the pressure chambers 211*b*.

The surface S3 of the plate 37 is formed with the 72 openings 272*a* and the 72 openings 272*b*. The 72 openings 272*a* are in respective communication with the 72 openings 36*a* of the plate 36 and the 72 openings 272*b* are in respective communication with the 72 openings 36*b* of the plate 36. The surface S3 defines the openings 272*a* and the openings 272*b*. The respective openings 272*a* are openings of the respective spaces 27 formed in the plate 37 at the side of the plate 36. The respective openings 272*b* are also openings of the respective spaces 27 formed in the plate 37 at the side of the plate 36. Further, the plate 37 has a plate portion 21*c* arranged between the openings 272*a* and the openings 272*b* along the first direction. The plate portion 21*c* superimposes the plate portion 21*g* of the plate 36. The plate portion 21*c* corresponds to the projection projecting from the plate portion 21*g* of the plate 36 toward the nozzles 201. The plate portion 21*g* of the plate 36 is a smooth portion having a smooth surface extending in the first direction.

The descender channels 213*a*, which are provided for the pressure chambers 211*a* forming the first pressure chamber row Qa from the left of the page of FIG. 2, respectively connect the right ends of the pressure chambers 211*a* forming the pressure chamber row Qa and the corresponding channels 214 through the openings 36*a* and the openings 272*a*. Much the same is true as the first pressure chamber row Qa on the third pressure chamber row Qb, the fifth pressure chamber row Qa, the seventh pressure chamber row Qb, the ninth pressure chamber row Qa, and the eleventh pressure chamber row Qb, from the left of the page of FIG. 2. The descender channels 213*b*, which are provided for the pressure chambers 211*b* forming the second pressure chamber rows Qb from the left of the page of FIG. 2, respectively connect the left ends of the pressure chambers 211*b* forming the pressure chamber row and the corresponding channels 214 through the openings 36*b* and the openings 272*b*. Much the same is true as the second pressure chamber row Qb on the fourth pressure chamber row Qa, the sixth pressure chamber row Qb, the eighth pressure chamber row Qa, the tenth pressure chamber row Qb, and the twelfth pressure chamber row Qa, from the left of the page of FIG. 2.

Figure 6:
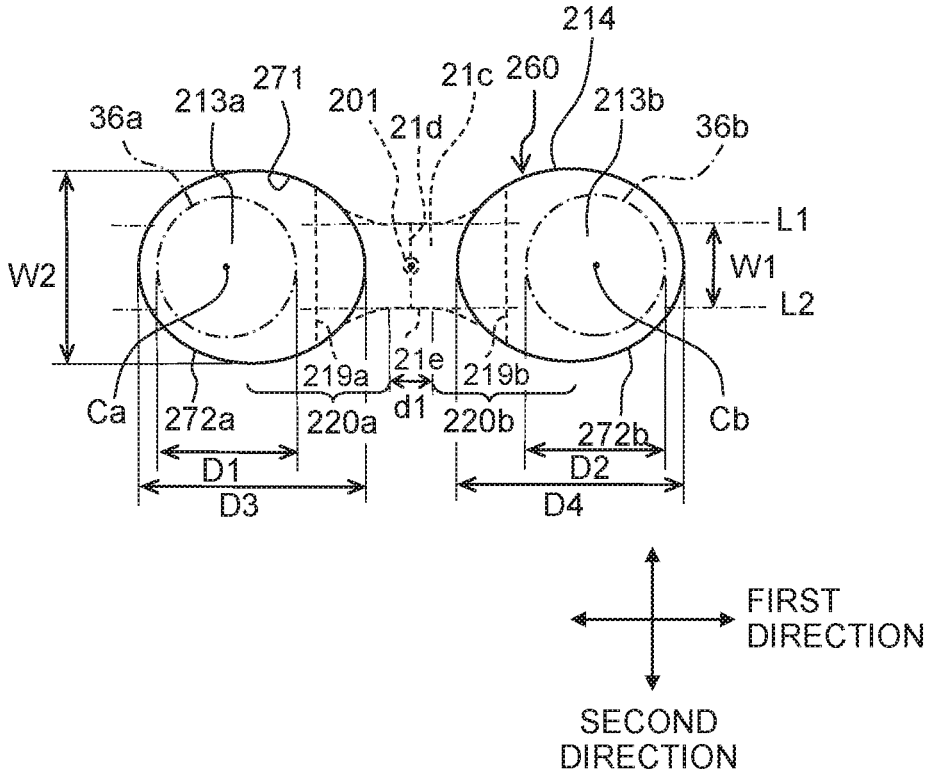
FIG. 6 is an enlarged view of a channel in FIG. 4.

Next, referring to FIGS. 4 to 7, the link channels 260 will be explained. Further, FIG. 6 depicts the shape of the channels 214 as viewed from above via the plate 37, and depicts at the same time the contour shape of the nozzles 201, the contour shape of the openings 272*a* overlapping with the openings 36*a*, and the contour shape of the openings 272*b* overlapping with the openings 36*b*.

The channels 214 of the link channels 260 extend in the first direction to link the pressure chambers 211*a* and the pressure chambers 211*b*. The openings 272*a* are provided in the ends of the channels 214 on one side along the first direction while the openings 272*b* are provided in the ends of the channels 214 on the other side along the first direction.

In this embodiment, the size of each of the openings 272*a* in the first direction is larger than the size of each of the openings 272*a* in a second direction which is along the surface S1 and orthogonal to the first direction. Further, the size of each of the openings 272*b* in the first direction is larger than the size of each of the openings 272*b* in the second direction (see FIG. 6).

When viewed from the direction perpendicular to the surface S1, the channels 214 has a width W1 of central portions in the longitudinal direction (communication portions 21*d* in communication with the nozzles 201) smaller than the maximum diameter D1 of each of the openings 36*a* and the maximum diameter D2 of each of the openings 36*b*.

Figure 7:
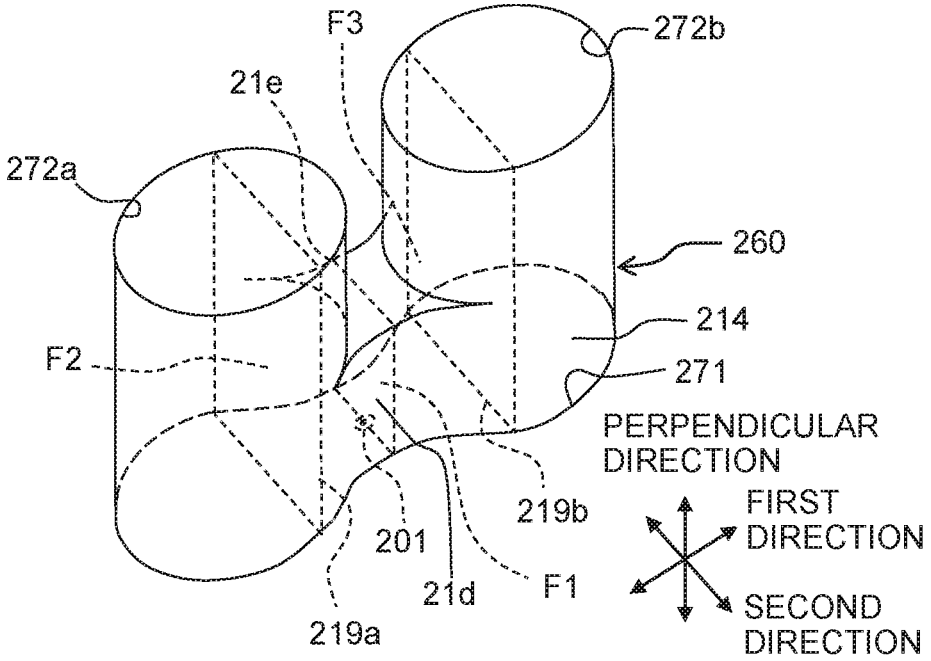
FIG. 7 is a perspective view of the channels in FIG. 4.

In the channels 214, the communication portions 21*d* have a cross-sectional area of a cross section F1 perpendicular to the first direction smaller than the cross-sectional areas of cross sections F2 and F3 perpendicular to the first direction of the other parts (for example, in FIGS. 6 and 7, the parts 219*a* between the communication portions 21*d* and the openings 36*a*, and the parts 219*h* between the communication portions 21*d* and the openings 36*b*). That is, each of the areas of the cross sections F2 and F3 is larger than the area of the cross section F1.

Therefore, when the ink flows through the channels 214 in the first direction, the ink flowing through the communication portions 21*d* is faster than the ink flowing through the two opposite ends of the communication portions 21*d* along the first direction. With such an aspect, the other parts in the channels 214 have the parts 219*a* and the parts 219*b*.

Further, in this embodiment, in terms of the cross-sectional area, the channels 214 increase from the communication portions 21*d* toward the parts 219*a*, and increase from the communication portions 21*d* toward the parts 219*b*. The parts 219*a* and the parts 219*b* may be sized to have the same width and the same cross-sectional area, respectively.

Further, the channels 214 have a smaller cross-sectional area of the cross section F1 than that of each cross section of the pressure chambers 211*a* and the pressure chambers 211*b* perpendicular to the first direction. Therefore, when the ink flows through the channels 214 in the first direction, the ink flowing through the communication portions 21*d* is faster than the ink flowing through the pressure chambers 211*a* and the pressure chambers 211*b*.

The communication portions 21*d* have straight portions 21*e*. The straight portions 210 are set to be constant both in cross-sectional area and in cross-sectional shape from the centers of the channels 214 in the first direction (the nozzle axial centers of the nozzles 201 in this embodiment) toward the two opposite ends. As depicted in FIG. 6, as viewed from the direction perpendicular to the surface S1, the centers Ca of the openings 36*a* and the centers Cb of the openings 36*h* are positioned between virtual lines L1 and L2. The virtual lines L1 and L2 are imagined lines extending in the first direction along the inner wall defining the two opposite ends of the straight portions 21*e* in the width direction. In this embodiment, the straight portions 21*e* have a length d1 in the first direction smaller than the maximum diameter D1 of each of the openings 36*a* and the maximum diameter D2 of each of the openings 36*b*.

The channels 214 have wide portions 220*a* and 220*b*. The wide portions 220*a* and 220*b* extend, as viewed from the direction perpendicular to the surface S1, to curve such that the widths of the channels 214 may expand from the straight portions 21*e* toward the two opposite ends in the first direction, respectively. Further, as viewed from the direction perpendicular to the surface S1, the inner wall defining the wide portions 220*a* and 220*b* has such a curvature radius as larger than that of the incident diameter of the nozzles 201 (the inner diameter of the nozzles 201 at the closest position to the channels 214).

In this embodiment, as viewed from the direction perpendicular to the surface S1, each of the wide portions 220*a* and 220*b* has a symmetrical shape with respect to a line passing through the center of the nozzle 201 and being parallel to the second direction. Further, as viewed form the direction perpendicular to the surface S1, each of the channels 214 may have a symmetrical shape with respect to a line passing through the center of the nozzle 201 and being parallel to the second direction.

Further, as viewed form the direction perpendicular to the surface S1, the openings 36*a* and the openings 36*b* are within the projections of the channels 214, respectively. That is, as viewed from the direction perpendicular to the surface S1, the openings 36*a* and the openings 36*b* are within the projections of the openings 271, respectively. Further, as viewed form the direction perpendicular to the surface S1, the openings 36*a* are respectively within the projections of the openings 272*a* and the openings 36*b* are respectively within the projections of the openings 272*b*.

Further, as viewed from the direction perpendicular to the surface S1, the maximum diameter D1 of each of the openings 36*a* and the maximum diameter D2 of each of the openings 36*b* are smaller than the maximum width W2 of each of the openings 272*a* and the openings 272*b* (in other words, the maximum width of each of the openings 271). Further, the maximum diameter D1 of each of the openings 36*a* is smaller than the maximum diameter D3 of each of the openings 272*a*. Further, the maximum diameter D2 of each of the openings 36*b* is smaller than the maximum diameter D4 of each of the openings 272*b*. As viewed from the direction perpendicular to the surface S1, the openings 272*a* and 272*b* are elongate openings whose maximum diameters D3 and D4 are larger than the maximum width W2, in the first direction.

Note that as depicted in FIGS. 4 and 5, the nozzles 201 extend in the direction perpendicular to the surface S1. As viewed from the direction perpendicular to the surface S1, the width W1 of the straight portions 21*e* is set at a value which is at least 80 μm larger than the incident diameter of the nozzles 201.

As depicted in FIGS. 2 to 4, the manifolds 215*a* and 215*b* are formed by overlapping, in the direction perpendicular to the surface S1, the through holes penetrating through the plates 34 and 35, with recesses 218*a* and recesses 218*b* formed in the surface of the plate 36 facing the plate 35.

The four manifolds 215*a* are arranged at intervals in the scanning direction. Each of the four manifolds 215*a* extends in the conveyance direction. Further, the three manifolds 215*b* are arranged at intervals in the scanning direction. Each of the three manifolds 215*b* also extends in the conveyance direction. Each of the manifolds 215*b* is arranged between two adjacent manifolds 215*a* in the scanning direction.

Due to the drives of the pumps P1 to P3, the ink flowing through the pipe 9 to supply the ink jet head 3 from the supply ports 3*a* is further supplied to the manifolds 215*a*. The ink supplied to the manifolds 215*a* from the supply ports 3*a* is further supplied to the throttle channels 212*a* and 212*b*.

Then, the ink is supplied to the manifolds 215*b* after flowing through and in the order of one of each pair of the throttle channels 212*a* and 212*b*, one of each pair of the descender channels 213*a* and 213*b*, the other of each pair of the descender channels 213*a* and 213*b*, and the other of each pair of the throttle channels 212*a* and 212*b*.

Further, due to the drives of the pumps P1 to P3, the ink supplied to the manifolds 215*b* is discharged to the pipe 9 from the supply ports 3*b*. The ink discharged from the supply ports 3*b* is returned to the negative pressure tank 12 through the pipe 9. By virtue of this, in this embodiment, the ink is circulated between the ink jet head 3 and the tanks 11 and 12.

The damper chambers 216*a* and 216*b* are formed in the plate 37. The damper chambers 216*a* are formed in positions overlapping with the manifolds 215*a* along the direction perpendicular to the surface S1, while the damper chambers 216*b* are formed in positions overlapping with the manifolds 215*b* along the direction perpendicular to the surface S1.

The damper chambers 216*a* are distanced from the manifolds 215*a* by partition walls 217*a* formed in the plate 36. The damper chambers 216*b* are distanced from the manifolds 215*b* by partition walls 217*b* formed in the plate 36. The damper chambers 216*a* and 216*b* allow the partition walls 217*a* and 217*b* to deform along the direction perpendicular to the surface S1. Due to the deformation of the partition walls 217*a* and 217*b*, the ink inside the manifolds 215*a* and 215*b* is restrained respectively from pressure variation.

The Piezoelectric Elements

The piezoelectric elements 22*c* apply a pressure to the ink flowing through the pressure chambers 211*a* and 211*b* to jet the ink from the nozzles 201. In the ink jet head 3, the 144 piezoelectric elements 22*c* are provided to correspond respectively to the 144 pressure chambers 211*a* and 211*b*.

As depicted in FIGS. 2 to 4, an actuator 22 is provided on the surface of the channel unit 21 at the other side than the nozzle plate 20. The actuator 22 is constructed from two piezoelectric layers 25 and 26, a common electrode 27, 144 individual electrodes 28, and a vibration plate, and has the 144 piezoelectric elements 22*c*. The piezoelectric layers 25 and 26 are formed of a piezoelectric material. For example, a piezoelectric material whose main component is lead zirconate titanate (PZT) may be used.

The piezoelectric layer 25 is arranged to superimpose the plate 31 of the channel unit 21 while the piezoelectric layer 26 is arranged to superimpose the piezoelectric layer 25. The piezoelectric layer 25 may be formed of a different material from the piezoelectric layer 26. In such a case, the piezoelectric layer 25 may be formed of, for example, an insulating material other than piezoelectric materials such as a synthetic resin material or the like.

The common electrode 27 is arranged between the piezoelectric layer 25 and the piezoelectric layer 26 to extend continuously throughout almost the entire area of the piezoelectric layers 25 and 26. The common electrode 27 is kept at the ground potential. The 144 individual electrodes 28 are provided individually for the total of 144 pressure chambers 211*a* and 211*b*.

As viewed from the direction perpendicular to the surface S1, the respective individual electrodes 28 have an approximately rectangular planar shape elongated in the scanning direction. The respective individual electrodes 28 are arranged to overlap with central positions of the corresponding pressure chambers 211*a* or 211*b* in an up/down direction. End portions of the respective individual electrodes 28 on the opposite side to the descender channels 213*a* or 213*b* in the scanning direction extend up to positions not overlapping with the pressure chambers 211*a* or 211*b*, and their leading ends serve as connecting terminals 28*c* for connection with a wiring member.

The connecting terminals 28*c* of the 144 individual electrodes 28 are connected to a predetermined driver IC via the wiring member. The 144 individual electrodes 28 are set individually by the driver IC to either the ground potential or a predetermined drive potential (for example, 20 V or so). Further, by arranging the common electrode 27 and the 144 individual electrodes 28 in the above manner, such parts of the piezoelectric layer 26 as interposed between the individual electrodes 28 and the common electrode 27 function as active portions polarized in the direction perpendicular to the surface S1. Each of the piezoelectric elements 22*c* has an active portion polarized in the direction perpendicular to the surface S1.

In the piezoelectric elements 22*c*, all of the individual electrodes 28 are kept at the same ground potential as the common electrode 27 when the ink is not jetted from the nozzles 201 (in the standby state). Further, in the piezoelectric elements 22*c*, when the ink is jetted from a particular nozzle 201, the potential is switched to the predetermined drive potential applied to the two individual electrodes 28 corresponding to the pressure chamber 211*a* and the pressure chamber 211*b* connected to that particular nozzle 201.

Thereafter, such an electrical field arises as parallel to the polarization direction of the two piezoelectric elements 22*c* corresponding to the above two individual electrodes 28, such that the above two piezoelectric elements 22*c* contract in a horizontal direction orthogonal to the polarization direction of the above two piezoelectric elements 22*c*. By virtue of this, in the two piezoelectric elements 22*c*, such parts of the piezoelectric layers 25 and 26 as overlapping with the respective pressure chambers 211*a* and 211*b* along the up/down direction deform to project as a whole toward the pressure chambers 211*a* and 211*b*.

As a result, the volumes of the pressure chambers 211*a* and 211*b* decrease such that the ink pressure in the pressure chambers 211*a* and 211*b* increases, thereby jetting the ink from the particular nozzle 201. After the ink is jetted, the potential of the above two individual electrodes 28 returns to the ground potential. By virtue of this, the piezoelectric layers 25 and 26 are restored to the state before the deformation.

As explained above, according to the ink jet head 3, in the channels 214, because it is possible to increase the flow speed of the ink through the communication portions 21*d*, it is possible to shorten the time of the circulating ink being in contact with the ambient air through the nozzles 201. By virtue of this, it is possible to prevent the dried ink from staying in the vicinity of the nozzles 201.

Further, it is possible to lessen the channel resistance against the ink in the other parts than the communication portions 21*d* of the channels 214. Therefore, it is possible to prevent loss of the pressure generated in two pressure chambers 211*a* and 211*b* at the time of jetting the ink, when the pressure is transmitted to the vicinity of the nozzle 201. Further, because it is possible to lessen the channel resistance in the other places than the communication portions 21*d* of the channels 214, it is possible to reduce the pressure loss in the individual channels such as the pressure chambers 211*a* and 211*b* and the like. Hence, even if the pressure difference is lessened between the pressurizing tank 11 and the negative pressure tank 12, for example, it is still possible to circulate a sufficient flowing quantity of the ink.

Further, because the channels 214 have the parts 219*a* and the parts 219*b*, it is easier to raise the flow speed of the ink flowing through the communication portions 21*d* than the ink flowing through the two opposite ends of the communication portions 21*d* in the first direction.

Further, because the cross-sectional areas of the channels 214 increase as toward the two opposite ends along the first direction from the communication portions 21*d*. Therefore, from the ends on one side along the first direction (that is, the upstream ends) of the channels 214 toward the communication portions 21*d*, the ink flow speed can increase gradually while from the communication portions 21*d* toward the ends on the other side along the first direction (that is, the downstream ends), the ink flow speed can decrease gradually. By virtue of this, it is possible to cause the ink to flow smoothly inside the channels 214.

Further, the communication portions 21*d* have the straight portions 21*e* with the constant cross-sectional area and shape, through a predetermined distance from the centers of the channels 214 toward the two opposite ends in the first direction. By virtue of this, it is possible to cause the ink to flow smoothly inside the straight portions 21*e* while increasing the flow speed of the ink locally in the communication portions 21*d*.

Further, the channels 214 have the pairs of wide portions 220*a* and 220*b* and, as viewed from the direction perpendicular to the surface S1, the curvature radius of the inner walls defining the wide portions 220*a* and 220*b* is larger than the curvature radius of the incident diameters of the nozzles 201. By virtue of this, it is possible to cause the ink to flow smoothly inside the wide portions 220*a* and 220*b*.

Further, the nozzles 201 extend in the direction perpendicular to the surface S1. As viewed from the direction perpendicular to the surface S1, the width W1 of the straight portions 21*e* is set to a value larger than the incident diameters of the nozzles 201 by not less than 80 μm.

By virtue of this, in manufacturing the ink jet head 3, it is possible to preferably place the nozzles 201 inside the straight portions 21*e* and thereby to prevent a decrease in yield ratio, even if the nozzle plate 20 and the channel unit 21 are joined with a little positional deviation.

Further, as viewed from the direction perpendicular to the surface S1, the centers Ca and Cb of the openings 36*a* and 36*b* are positioned between the pair of virtual lines L1 and L2. Therefore, it is possible to cause the ink to flow smoothly along the first direction from the openings 36*a* toward the openings 36*b*.

Further, as viewed from the direction perpendicular to the surface S1, the openings 36*a* and the openings 36*b* lie within the projections of the openings 272*a* and the openings 272*b*, respectively. Therefore, it is possible to smoothly discharge the gas produced in the vicinity of the nozzles 201 from the channels 214 to the manifolds 215*b* via the openings 36*b*.

Further, as viewed from the direction perpendicular to the surface S1, the maximum diameters D1 and D2 of the openings 36*a* and 36*b* are smaller than the maximum width W2 of the channels 214. Therefore, for example, it is possible to efficiently supply the ink flowing through the descender channels 213*a* to the channels 214 via the openings 36*a* while it is possible to efficiently discharge ink flowing through the channels 214 to the descender channels 213*b* via the openings 36*b*.

Note that while the spaces 270 are defined by the one plate 37 in the first embodiment, the spaces 270 may be defined by two plates. In such a case, two through holes may be formed in the upper one of the two plates, whereas one through hole may be formed in the lower plate.

Modified Embodiments

Figure 8:
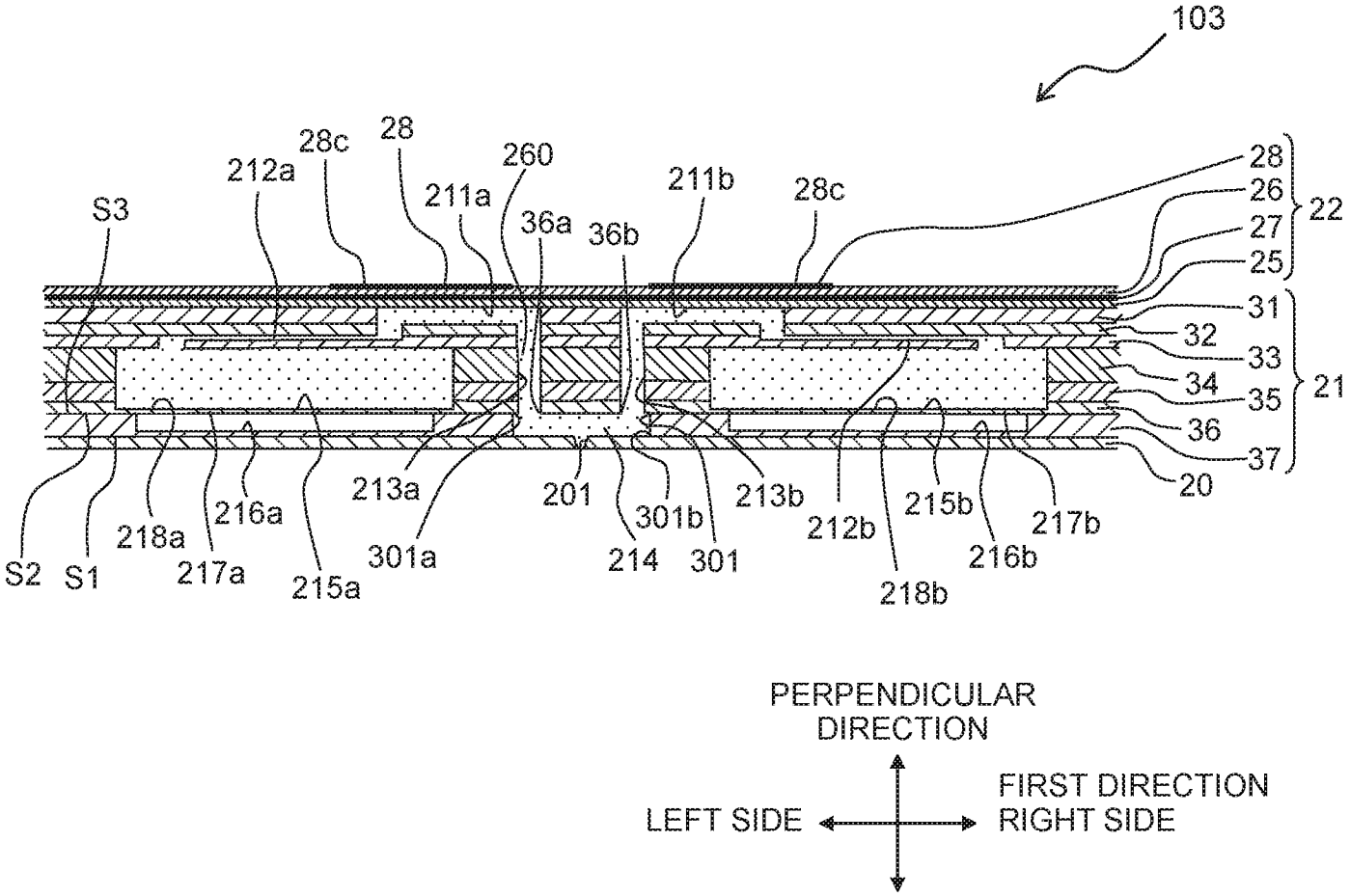
FIG. 8 is a cross-sectional view of an ink jet head according to a modified example of the first embodiment, corresponding to FIG. 4.
Figure 9:
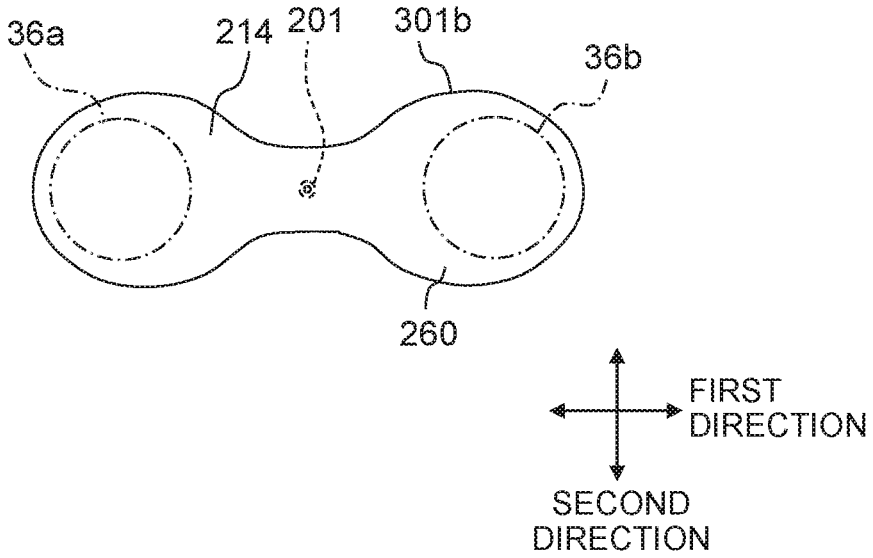
FIG. 9 is an enlarged view of the channel in FIG. 8.
Figure 10:
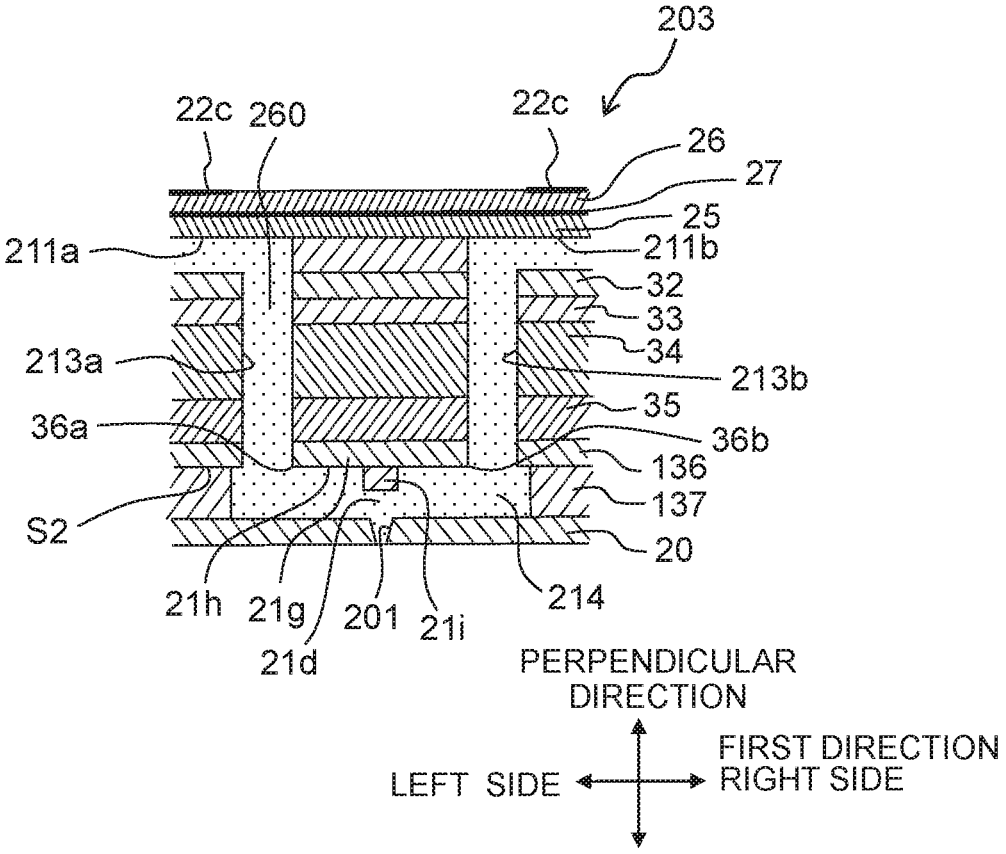
FIG. 10 is a cross-sectional view of an ink jet head according to a second embodiment of the present teaching, corresponding to a partially enlarged view of FIG. 4.
Figure 11:
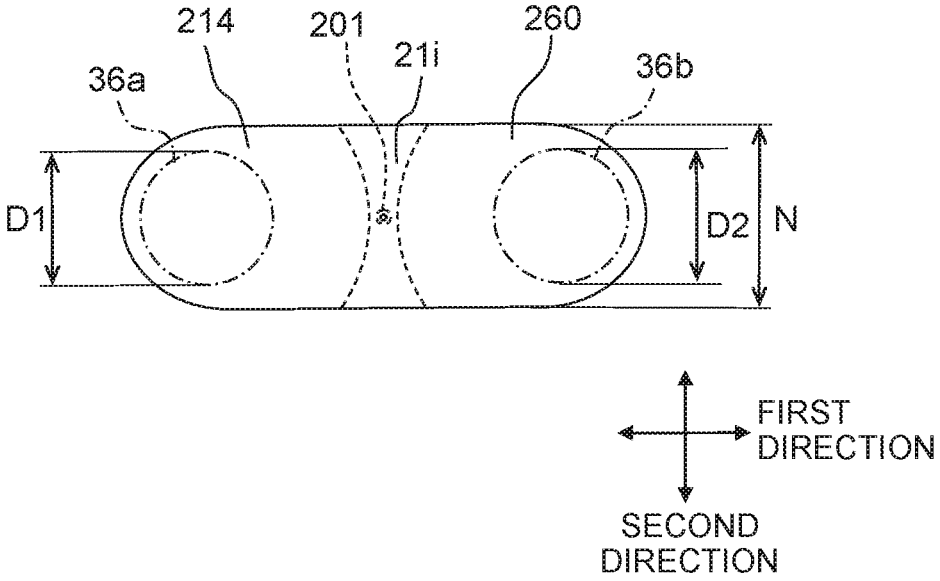
FIG. 11 is an enlarged view of the channel in FIG. 10.

Referring to FIGS. 8 and 9, a few of modified embodiments will be explained. As depicted in FIGS. 8 and 9, the channels 214 viewed from the direction perpendicular to the surface S1 have the same shape as the channels 214 of the first embodiment.

An ink jet head 103 has the same straight portions and wide portions as the ink jet head 3 in the first embodiment, but does not have the plate portion 21*c* of the plate 37. In the same manner as the channels 214 of the ink jet head 3, the channels 214 of the ink jet head 103 have such a cross-sectional area of the communication portions 21*d* perpendicular to the first direction as smaller than that of the other parts of the channels 214 perpendicular to the first direction.

Each through hole 301 constructing the channel 214 is formed in the plate 37 of the ink jet head 103. The through hole 301 extends from an opening 301*a* at the upper surface side of the plate 37 to an opening 301*b* at the lower surface side of the plate 37. The opening 301*a* defined by the upper surface of the plate 37 is in communication with the opening 36*a* being an end portion of the descender channel 213*a* at the left end along the first direction, and in communication with the opening 36*b* being an end portion of the descender channel 213*a* at the right end along the first direction.

The upper surface of the plate 37 is the surface S3 facing the plate 36. The surface S3 defines the single opening 301*a* in communication with the openings 36*a* and 36*b* of the plate 36. As viewed from the direction perpendicular to the surface S1, the openings 36*a* and 36*b* lie within the projection of the opening 301*a*.

In such a configuration as above, too, by joining the surface S3 and the surface S2, it is possible to render communication between the openings 36*a* and 36*b* and the channels 214. Hereinbelow, explanation will be made on other embodiments, focusing on the difference from the first embodiment.

Second Embodiment

As viewed from the direction perpendicular to the surface S1, each channel 214 in a second embodiment has a constant width N (along the second direction) from such a position as the opening 36*a* having the maximum diameter D1 to such a position as the opening 36*b* having the maximum diameter D2.

In the communication portion 21*d* of the channel 214, on such a surface of a plate 136 facing the nozzle 201 as on the side of a plate 137, there are formed a smooth portion 21*h* and a projection 21*i*. The smooth portion 21*h* has a smooth surface extending in the first direction while the projection 21*i* projects from the smooth portion 21*h* toward the nozzle 201. The smooth portion 21*h* corresponds to the surface S2 of the plate 136 while the projection 21*i* corresponds to such a plate portion of the plate 137 as arranged between the opening 36*a* and the opening 36*b*. In the first direction, the projection 21*i* is lengthened less than the plate portion 21*g*.

Because the channel 214 of the ink jet head 203 has the smooth portion 21*h* and the projection 21*i*, in the same manner as the ink jet head 3, the communication portion 21*d* has a smaller cross-sectional area perpendicular to the first direction than the cross-sectional areas of the other parts perpendicular to the first direction.

In the ink jet head 203 having the above configuration, too, the same effect is exerted as in the first embodiment. That is, by providing the projection 21*i*, in the link channels 260, it is possible to raise the flow speed of the ink flowing through the communication portions 21*d*, compared to the ink flowing through the two opposite sides away from the communication portions 21*d* of the link channels 260 along the first direction. Therefore, it is possible to shorten the time of the circulating ink being in contact with the ambient air through the nozzle 201. By virtue of this, it is possible to prevent the dried ink from detention in the vicinity of the nozzle 201.

Further, it is possible to comparatively lower the flow speed of the ink flowing in the other parts of the link channels 260 than the communication portions 21*d*. Therefore, in the communication portions 21*d* of the link channels 260, it is possible to prevent the circulating ink from pressure loss while raising the flow speed of the ink locally.

Figure 12:
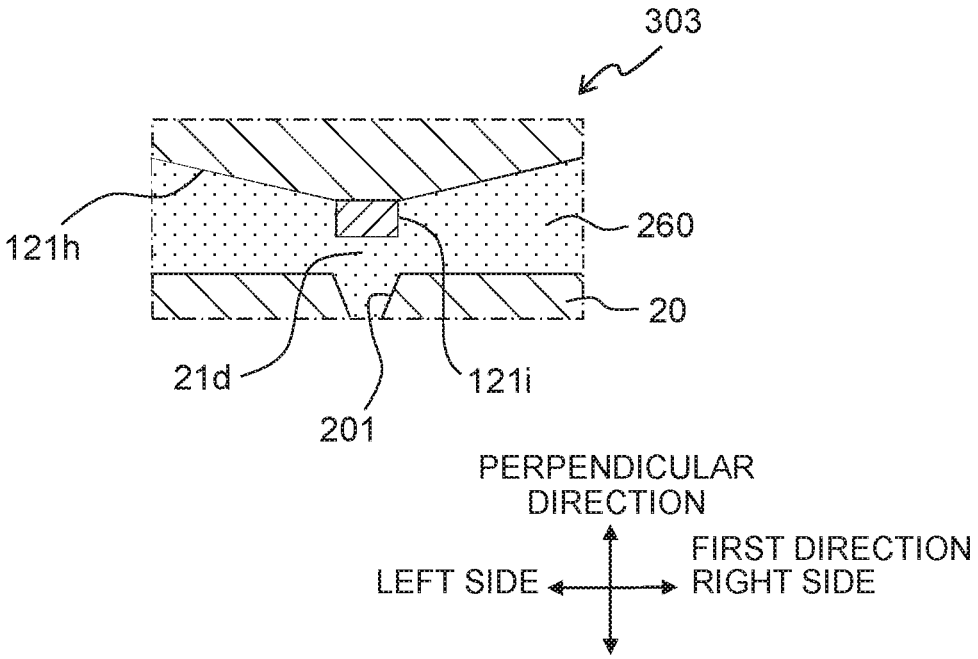
FIG. 12 is a cross-sectional view of an ink jet head according to a modified example of the second embodiment, corresponding to a partially enlarged view of FIG. 10.

Next, referring to FIG. 12, a modified embodiment based on the second embodiment will be explained. Along the surface of a smooth portion 121*h* in an ink jet head 303, a gradient is formed to descend to the nozzle 201 as approaches a projection 121*i*. According to such a configuration, it is possible to preferably lessen the channel resistance in the channels 214, compared to the second embodiment. By virtue of this, it is possible to cause the ink to flow through the communication portions 21*d* of the channel 214*s* at a higher speed so as to further prevent the ink from drying.

Third Embodiment

Figure 13:
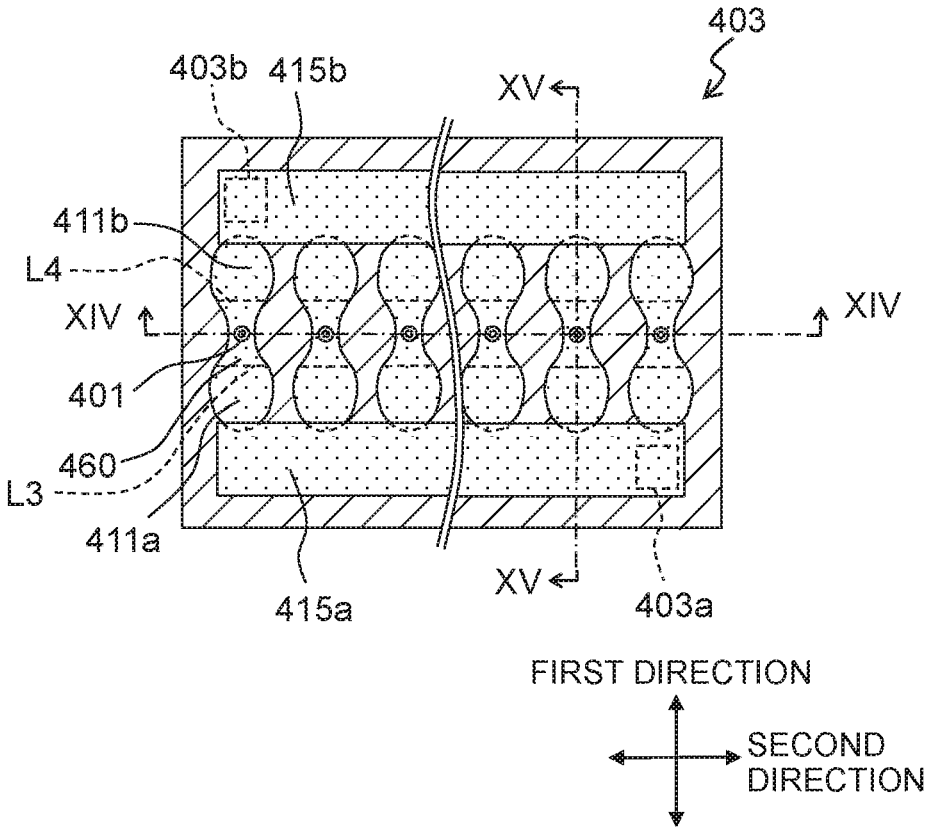
FIG. 13 is a plan view of an ink jet head according to a third embodiment of the present teaching.
Figure 14:
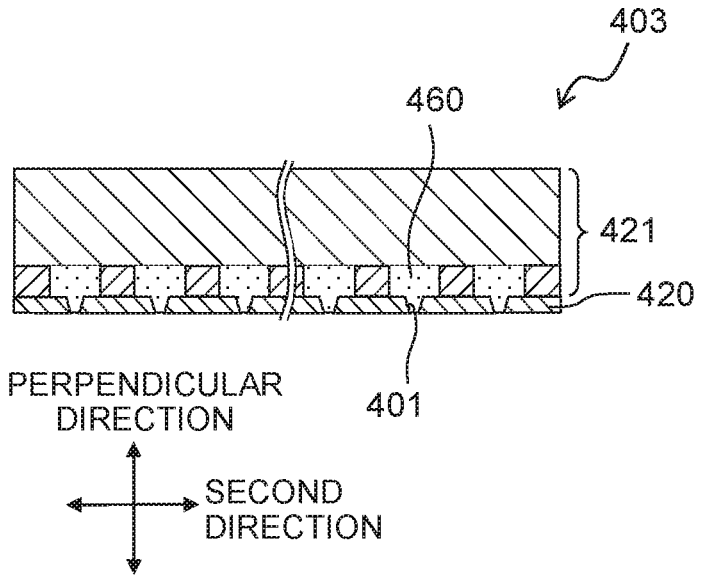
FIG. 14 is a cross-sectional view of FIG. 13 along the line XIV-XIV.
Figure 15:
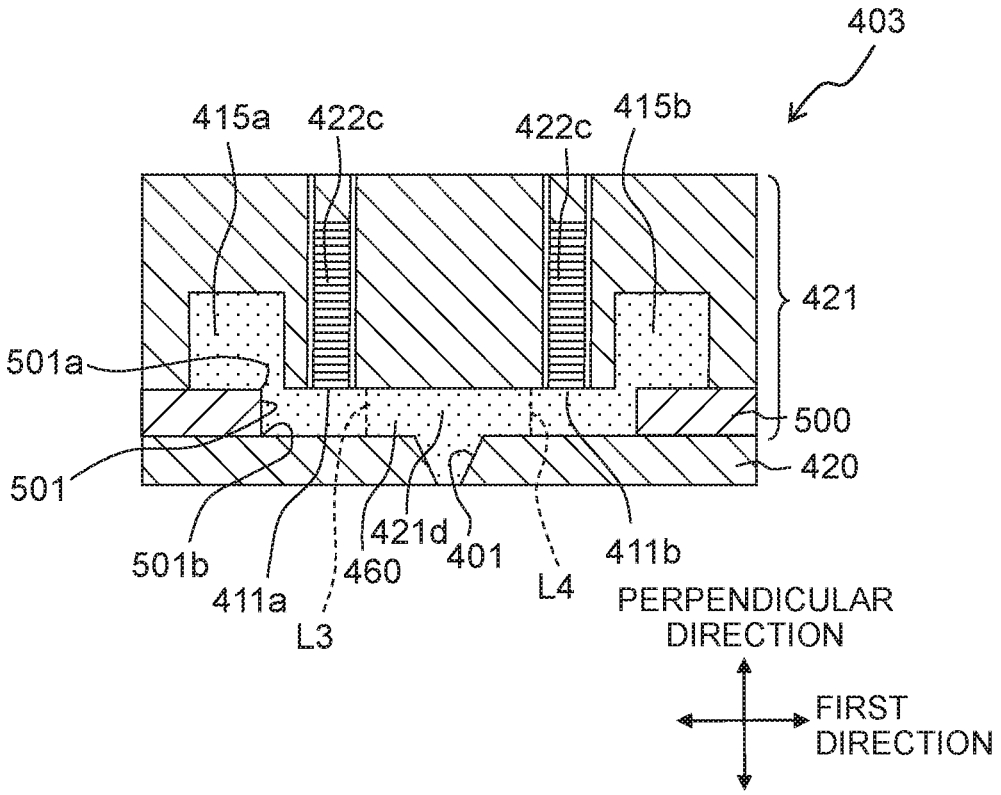
FIG. 15 is a cross-sectional view of FIG. 13 along the line XV-XV.

As depicted in FIGS. 13 to 15, an ink jet head 403 includes a nozzle plate 420 and a channel unit 421. In the channel unit 421, pressure chambers 411*a*, a link channel 460, and pressure chambers 411*b* align in the first direction. In other words, one end of the link channel 460 along the first direction is connected with the pressure chambers 411*a* while the other end of the link channel 460 along the first direction is connected with the pressure chambers 411*b*.

In the ink jet head 403, the pressure chambers 411*a* have such cross-sectional areas perpendicular to the first direction as 50% of the maximum value at first at the boundary position between the pressure chambers 411*a* and the link channel 460 (the position depicted with the broken line L3 in FIGS. 13 and 15), when that position is moved from a nozzle 401 toward a manifold 415*a* along the first direction.

Further, in the ink jet head 403, the pressure chambers 411*b* have such cross-sectional areas perpendicular to the first direction as 50% of the maximum value at first at the boundary position between the pressure chambers 411*b* and the link channel 460 (the position depicted with the broken line L4 in FIGS. 13 and 15), when that position is moved from the nozzle 401 toward a manifold 415*b* in the first direction.

The pressure chambers 411*a* are connected directly with the manifold 415*a* along the direction perpendicular to the surface S1. The pressure chambers 411*b* are connected directly with the manifold 415*b* along the direction perpendicular to the surface S1. The manifolds 415*a* and 415*b* extend respectively in the second direction.

One end of the manifold 415*a* along the longitudinal direction is connected to a supply port 403*a* while one end of the manifold 415*b* along the longitudinal direction is connected to a discharge port 403*b*. The supply port 403*a* corresponds to the supply port 3*a* in the first embodiment. The discharge port 403*b* corresponds to the discharge port 3*b* in the first embodiment.

Piezoelectric elements 422*c* are arranged in the channel unit 421 to overlap individually with the pressure chambers 411*a* and 411*b* along the direction perpendicular to the surface S1. The channel unit 421 includes a channel substrate 500 formed with a through hole 501 to construct the pressure chamber 411*a*, the link channel 460, and the pressure chamber 411*b*.

The through hole 501 extends from an opening 501*a* in the upper surface of the channel substrate 500 to an opening 501*b* in the lower surface of the channel substrate 500. The opening 501*a* defined by the channel substrate 500 is in communication with the manifold 415*a* at one end along the first direction, and in communication with the manifold 415*b* at the other end along the first direction. The channel substrate 500 is formed with the same number of such through holes 501 as the nozzles 401.

Further, the opening 501*b* defined by the lower surface of the channel substrate 500 defines the contours of the pressure chamber 411*a*, the link channel 460, and an end portion of the pressure chamber 411*b* at the side of the nozzle plate 420, respectively. The opening 501*b* is covered by the nozzle plate 420 having the nozzles 401. The ink jet head 403 does not include descender channels.

In the ink jet head 403, the overall shapes of a set of pressure chamber 411*a*, the link channel 460 and the pressure chamber 411*b* are set to be the same as the overall shapes of the channel 214 (see FIG. 6) in the first embodiment. In the link channel 460, a communication portion 421*d* in communication with the nozzle 401 has such a cross-sectional area of the cross section perpendicular to the first direction as smaller than the cross-sectional areas of the other parts of the cross section of the link channel 460 perpendicular to the first direction.

When the ink jet head 403 is driven, the ink supplied from the manifold 415*a* flows therethrough in the order of the pressure chamber 411*a*, the link channel 460 and the pressure chamber 411*b*, and is then sent to the manifold 415*b* so as to circulate. Further, by driving the piezoelectric elements 422*c* arranged to overlap with the pressure chamber 411*a* and the pressure chamber 411*b* along the direction perpendicular to the surface S1, the ink is jetted from the nozzle 401. In such ink jet head 403, too, the same effect is exerted as in the first embodiment.

Fourth Embodiment

Figure 16:
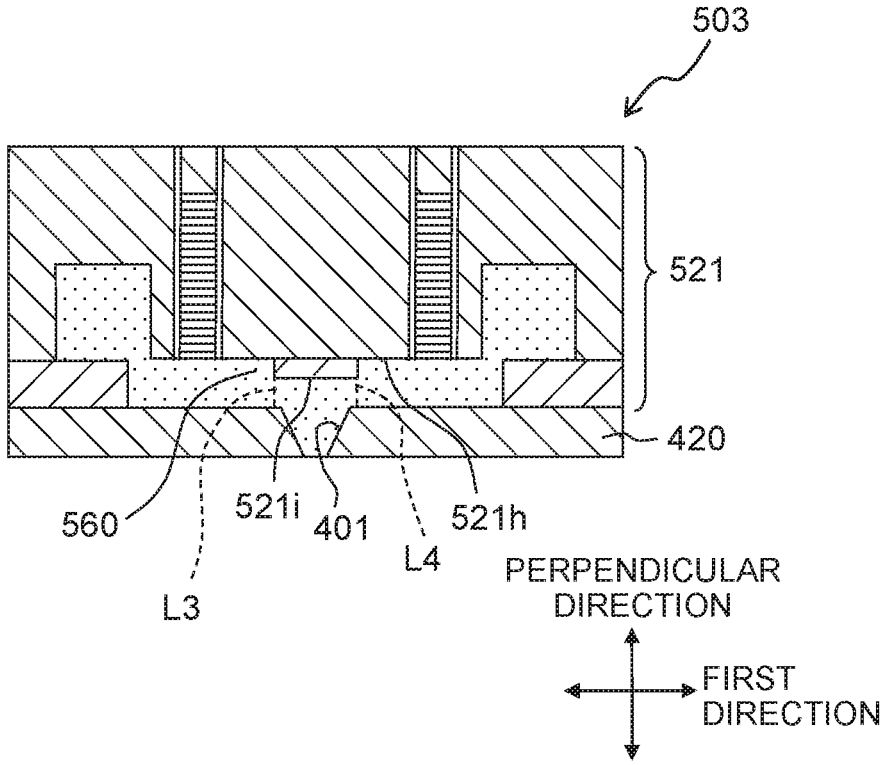
FIG. 16 is a cross-sectional view of an ink jet head according to a fourth embodiment of the present teaching.

As depicted in FIG. 16, a link channel 560 in a channel unit 521 of an ink jet head 503 according to a fourth embodiment of the present teaching has a constant width between one end and the other end along the first direction, as viewed from the direction perpendicular to the surface S1.

In this aspect, the ink jet head 503 differs from the ink jet head 403 according to the third embodiment. The ink jet head 503 has a smooth portion 521*h* and a projection 521*i* in the same manner as the ink jet head 103. By virtue of this, in the ink jet head 503, too, the same effect is exerted as in the second embodiment.

Note that in the same manner as in the second embodiment, a gradient may be formed to descend to the nozzle 401 as approaches a projection 521*i*.

In the above explanation, the surface S1 corresponds to the first surface, the surface S2 corresponds to the second surface, and the surface S3 corresponds to the third surface. Further, the plate 37 corresponds to the first channel member, and the stacked body of plates 31 to 36 corresponds to the second channel member. Further, the descender channel 213*a* corresponds to the first connecting channel, the descender channel 213*b* corresponds to the second connecting channel, and the channel 214 corresponds to the third connecting channel.

Further, the opening 36*a* corresponds to the first opening, and the opening 36*b* corresponds to the second opening. Further, pressure chambers 211*a* and 411*a* correspond to the first pressure chamber, and pressure chambers 211*b* and 411*b* correspond to the second pressure chamber. Further, the opening 272*a* corresponds to the third opening, and the opening 272*b* corresponds to the fourth opening. Further, parts 219*a* correspond to the first part, and parts 219*b* correspond to the second part.

The present teaching is not limited to the above embodiments but, without departing from the true scope and the spirit of the present teaching, its configuration may be changed, supplemented, and/or deleted.

In the above manner, the present teaching has an excellent effect in enabling prevention of jet defects of nozzles due to liquid drying in a liquid jetting apparatus including pressure chambers, and a link channel where the nozzles are disposed. Therefore, it is beneficial to widely apply the present teaching to liquid jetting apparatuses capable of fulfilling the significance of the effect.

What is claimed is:

1. A liquid jetting apparatus comprising:

a nozzle plate having a nozzle; and a channel unit having a first surface facing the nozzle plate, the first surface being joined with the nozzle plate, wherein the channel unit has: a first channel member having the first surface; and a second channel member having a second surface facing the first channel member, the second surface being joined with the first channel member, wherein the second channel member is formed with: a first pressure chamber; a second pressure chamber; a first opening defined by the second surface; a second opening defined by the second surface; a first connecting channel connecting the first pressure chamber and the first opening; and a second connecting channel connecting the second pressure chamber and the second opening, wherein the first channel member is formed with a third connecting channel connecting the first pressure chamber and the second pressure chamber, the third connecting channel communicating with the first connecting channel through the first opening and communicating with the second connecting channel through the second opening, and wherein in the third connecting channel, a communication portion in communication with the nozzle has a cross-sectional area perpendicular to a first direction smaller than that of another portion, the first direction being a direction along the first surface.

2. The liquid jetting apparatus according to claim 1, wherein the communication portion is in communication with the nozzle at a position between the first opening and the second opening in the first direction, wherein the another portion in the third connecting channel has a first part and a second part, the first part being positioned between the communication portion and the first opening in the first direction, the second part being positioned between the communication portion and the second opening in the first direction, wherein the first part has a cross-sectional area perpendicular to the first direction larger than that of the communication portion, and wherein the second part has a cross-sectional area perpendicular to the first direction larger than that of the communication portion.

3. The liquid jetting apparatus according to claim 2, wherein the third connecting channel has a cross-sectional area, perpendicular to the first direction, increasing from the communication portion toward the first part and increasing from the communication portion toward the second part.

4. The liquid jetting apparatus according to claim 1, wherein the first channel member has a third surface facing the second channel member, wherein the third surface defines a third opening and a fourth opening, the third opening being in communication with the first opening, the fourth opening being in communication with the second opening, wherein the first channel member has a plate portion arranged between the third opening and the fourth opening in the first direction, wherein the size, of the third opening, in the first direction is larger than the size, of the third opening, in a second direction which is parallel to the first surface and orthogonal to the first direction, and wherein the size, of the fourth opening, in the first direction is larger than the size, of the fourth opening, in the second direction.

5. The liquid jetting apparatus according to claim 4, wherein as viewed from a direction perpendicular to the first surface, the first opening is within a projection of the third opening and the second opening is within a projection of the fourth opening.

6. The liquid jetting apparatus according to claim 1, wherein the first channel member has a third surface facing the second channel member, and wherein the third surface defines an opening in communication with the first opening and the second opening.

7. The liquid jetting apparatus according to claim 6, wherein as viewed from a direction perpendicular to the first surface, the first opening and the second opening are within a projection of the opening.

8. The liquid jetting apparatus according to claim 1, wherein the communication portion has a straight portion which has a constant cross-sectional area and a constant cross-sectional shape through a predetermined distance in the first direction from the center of the third connecting channel toward each of two ends of the third connecting channel.

9. The liquid jetting apparatus according to claim 8, wherein the third connecting channel has a pair of wide portions each extending while curving, the width of each of the wide portions increasing from the straight portion toward one of the two ends of the third connecting channel as viewed from a direction perpendicular to the first surface, and wherein as viewed from the direction perpendicular to the first surface, an inner wall defining the wide portions has a curvature radius larger than a curvature radius of an incident diameter of the nozzle.

10. The liquid jetting apparatus according to claim 8, wherein the nozzle extends in a direction perpendicular to the first surface, and wherein as viewed from the direction perpendicular to the first surface, the width of the straight portion is set at a value which is larger than an incident diameter of the nozzle by 80 μm or more.

11. The liquid jetting apparatus according to claim 8, Wherein as viewed from a direction perpendicular to the first surface, the centers of the first opening and the second opening are positioned between a pair of virtual lines extending in the first direction along an inner wall defining both sides, of the straight portion, in a width direction of the straight portion.

12. The liquid jetting apparatus according to claim 1, Wherein as viewed from a direction perpendicular to the first surface, the maximum diameter of each of the first opening and the second opening is smaller than the maximum width of the third connecting channel.

13. The liquid jetting apparatus according to claim 1, wherein in the communication portion of the third connecting channel, a smooth portion and a projection are formed on an inner wall facing the nozzle, the smooth portion having a smooth surface extending in the first direction, the projection projecting from the smooth portion toward the nozzle.

14. The liquid jetting apparatus according to claim 13, wherein the smooth portion has a surface inclined to approach the nozzle toward the projection.

* * * * *